US008601989B2

(12) United States Patent
Ohsawa

(10) Patent No.: US 8,601,989 B2
(45) Date of Patent: Dec. 10, 2013

(54) VARIABLE VALVE GEAR FOR INTERNAL COMBUSTION ENGINE

(75) Inventor: Hiroshi Ohsawa, Shizuoka-ken (JP)

(73) Assignee: Suzuki Motor Corporation (JP)

( * ) Notice: Subject to any disclaimer, the term of this patent is extended or adjusted under 35 U.S.C. 154(b) by 133 days.

(21) Appl. No.: 13/291,482

(22) Filed: Nov. 8, 2011

(65) Prior Publication Data

US 2012/0111294 A1 May 10, 2012

(30) Foreign Application Priority Data

Nov. 8, 2010 (JP) ..... 2010-249927

(51) Int. Cl.
*F01L 1/34* (2006.01)

(52) U.S. Cl.
USPC ..... 123/90.16; 123/90.39

(58) Field of Classification Search
USPC ..... 123/90.16, 90.39; 74/559, 569
See application file for complete search history.

(56) References Cited

U.S. PATENT DOCUMENTS 6,874,472 B2 * 4/2005 Shimizu ..... 123/406.11
2009/0288623 A1 11/2009 Lee et al.

FOREIGN PATENT DOCUMENTS

DE 102008015787 A1 10/2009
JP 08218831 8/1996
JP 2003106123 A 4/2003
JP 2006070736 A 3/2006

OTHER PUBLICATIONS

Franke, Rudolf: Vom Aufbau der Getriebe. vol. 1: Die Entwicklungslehre der Getriebe. Zweite verbesserte Auflage. Berlin (u. a.): BeuthVertrieb GmbH, 1948, pp. 19-25 and 28.
German Office Action for Application No. 102011118750 dated Jun. 28, 2013.

* cited by examiner

*Primary Examiner* — Zelalem Eshete
(74) *Attorney, Agent, or Firm* — Lerner, David, Littenberg, Krumholz & Mentlik, LLP

(57) ABSTRACT

In the present invention, control shafts (11A, 11B) having bodies (16A, 16B) and control arm parts (17A, 17B) extending from the bodies (16A, 16B) toward the outer side in the radial direction are rotatably provided on the outer peripheral surface of a drive camshaft (2). A cam follower (13) is oscillatably mounted to the control arm parts (17A, 17B) via a support shaft (25). Oscillating arm parts (35A, 35B) extending toward the position opposite to a drive cam (3) across a cam follower roller (27) are provided on oscillating cams (14A, 14B). A central shaft (26) of the cam follower roller (27) is connected to the oscillating arm parts (35A, 35B) by link arms (29A, 29B) of which both longitudinal ends are rotatably connected to the central shaft (26) of the cam follower roller (27) and the oscillating arm parts (35A, 35B).

7 Claims, 7 Drawing Sheets

VARIABLE VALVE GEAR FOR INTERNAL COMBUSTION ENGINE

CROSS-REFERENCE TO RELATED APPLICATIONS

This application claims priority from Japanese Patent Application No. 2010-249927 filed Nov. 8, 2011, the disclosure of which is hereby incorporated herein by reference.

FIELD OF THE INVENTION

The present invention relates to a variable valve gear of an internal combustion engine. More particularly, the present invention relates to a variable valve gear of an internal combustion engine for changing lift characteristics of a valve.

BACKGROUND OF THE INVENTION

An internal combustion engine of a vehicle may be provided with a variable valve gear including a cam follower oscillated by a drive cam and an oscillating cam oscillated by the cam follower to open and close a valve, the variable valve gear opening and closing the valve by oscillating the oscillating cam using a drive force transmitted from the cam follower to the oscillating cam while changing the lift characteristics of the valve using the drive force transmitted to the oscillating cam.

A variable valve gear disclosed in Japanese Patent No. 4362249 is provided with a second interposing arm (cam follower) oscillated by a rotary cam (drive cam) of a camshaft (drive camshaft) and a first interposing arm (oscillating cam) oscillated by the second interposing arm, the variable valve gear opening and closing a valve by the oscillation of the first interposing arm and changing an oscillation amount of the first interposing arm by changing an arm ratio of the second interposing arm.

A variable valve gear disclosed in Japanese Patent No. 4026634 is provided with a control shaft in parallel with a camshaft having a drive cam, an oscillating member (oscillating cam) on the control shaft, an intermediate member (cam follower) in contact with the drive cam between the drive cam and the oscillating member, a control member rotatable on the camshaft, a support member on the control member, and a rotary interlocking mechanism for interlocking the rotation of the control member to the control shaft, the variable valve gear changing a rotary angle of the control shaft and changing a position of the intermediate member on a surface of the drive cam and a position thereof on a surface of a slide.

In the conventional variable valve gears disclosed in Japanese Patent No. 4362249 and Japanese Patent No. 4026634, a rocker arm or an oscillating cam has a contact surface where the rocker arm and the oscillating cam are in contact with a roller of which a relative position is changed with respect to the rocker arm and the oscillating cam. Therefore, in order to ensure the contact surface of the roller, a long rocker arm is necessary in Japanese Patent No. 4362249 and a long oscillating cam is necessary in Japanese Patent No. 4026634. Consequently, a device is disadvantageously enlarged and mountability in an internal combustion engine is impaired.

As shown in FIG. 10, in the conventional variable valve gears, the maximum lift position of a valve is approximately constant (as shown by dashed line P) and therefore, it is difficult to adjust a valve timing in accordance with a lift state of the valve. Thus, the pumping loss and the fuel consumption are disadvantageously increased.

SUMMARY OF THE INVENTION

An object of the present invention is to provide a variable valve gear of an internal combustion engine for reducing the size of a device and improving mountability in the internal combustion engine.

According to the invention, a variable valve gear of an internal combustion engine for opening and closing a valve by transmitting oscillation of a cam follower to an oscillating cam and changing lift characteristics of the valve by relatively moving a center of a cam follower roller with respect to a center of the oscillating cam includes: a drive camshaft including a drive cam; the oscillating cam including a base part and a lift part on an oscillating camshaft arranged in parallel with the drive camshaft to be oscillatable; the cam follower including a longitudinal one end oscillatably connected to a support shaft and a longitudinal other end having a cam follower roller contacting the drive cam, the cam follower being arranged between the drive camshaft and the oscillating camshaft to cross through a straight line connecting a center of the drive cam and a center of the oscillating cam, in which a control shaft having a hollow body and a control arm part extending from the body toward an outer side in a radial direction is rotatably provided on an outer peripheral surface of the drive camshaft, the cam follower is oscillatably mounted to the control arm part via the support shaft, an oscillation arm part extending toward a position opposite to the drive cam across the cam follower roller is provided on the oscillating cam, and a central shaft of the cam follower roller and the oscillating arm part are connected to each other by a link arm of which both longitudinal ends are rotatably connected to the central shaft of the cam follower roller and the oscillating arm part.

According to the present invention, the device can be reduced in size and the mountability in the internal combustion engine can be improved.

DETAILED DESCRIPTION OF PREFERRED EMBODIMENTS

The present invention has been made to realize the objectives of reducing the size of a device and improving mountability in an internal combustion engine by providing a link arm on a cam follower and connecting the link arm to an oscillating cam.

FIGS. 1 to 9 show an embodiment of the present invention.

Figure 1:
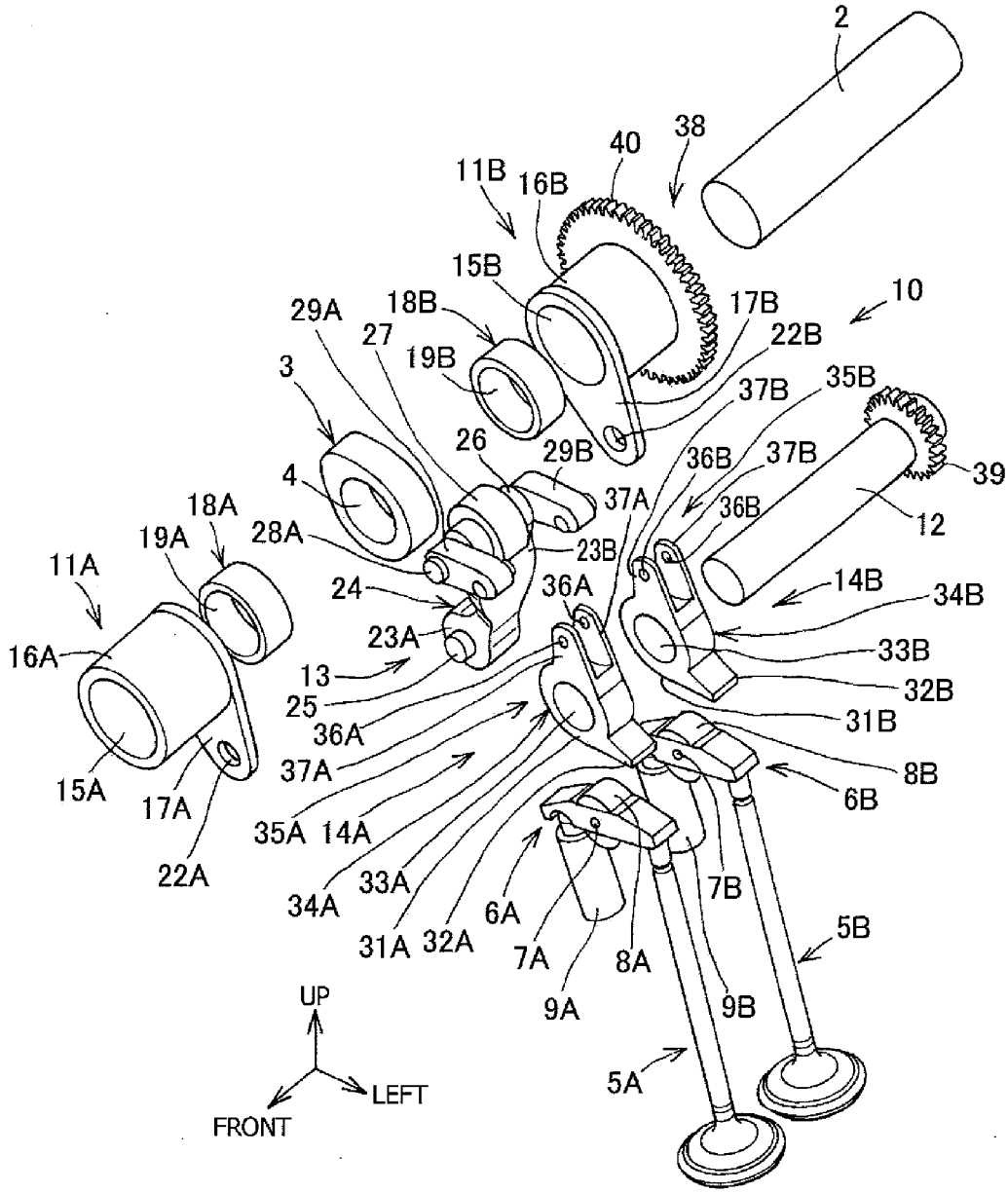
FIG. 1 is an exploded perspective view showing a variable valve gear of an internal combustion engine according to an embodiment of the present invention.
Figure 2:
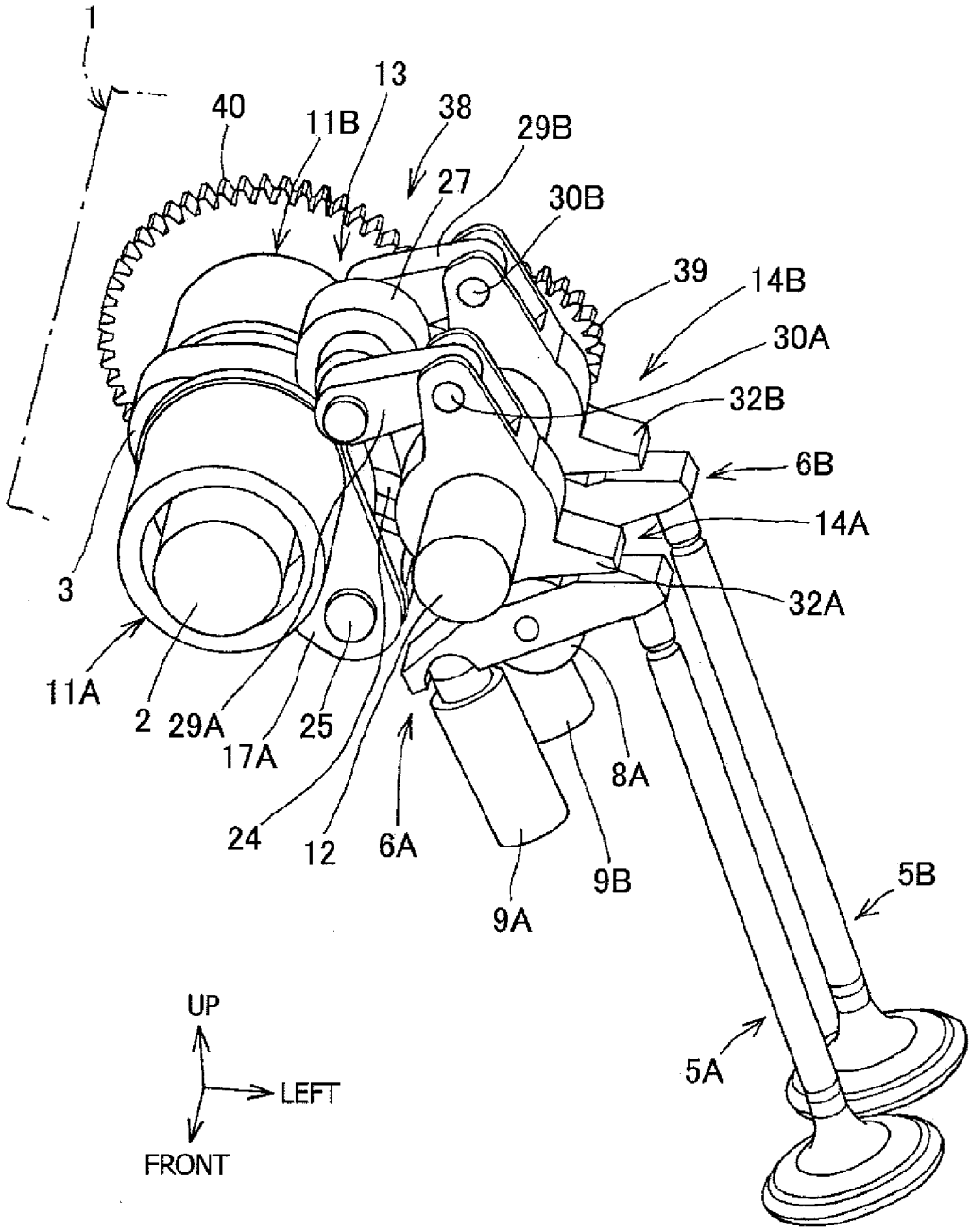
FIG. 2 is a perspective view showing the variable valve gear of the internal combustion engine according to the embodiment of the present invention.

In FIGS. 1 and 2, the reference numeral 1 denotes a multicylindered internal combustion engine vertically mounted in a vehicle. Hereinafter, in the internal combustion engine 1, the axial direction of a crankshaft is referred to as the longitudinal direction, the axial direction of a cylinder is referred to as the vertical direction, and the direction orthogonal to the crankshaft axis and the central line of the cylinder is referred to as the horizontal direction.

In the internal combustion engine 1, a drive camshaft 2 is pivoted by a cylinder head.

The drive camshaft 2 is arranged so as to extend in the longitudinal direction and rotate in synchronization with a crankshaft via a timing chain or a timing belt. In other words, the drive camshaft 2 rotates one-half for each one rotation of the crankshaft. The drive camshaft 2 is provided with a drive cam 3 which is formed separately and fitted to the drive camshaft 2 by a fixing means such as press-fitting. The drive cam 3 is formed with a camshaft hole 4 through which the drive camshaft 2 is inserted.

The cylinder head of the internal combustion engine 1 is provided with a one-side intake valve 5A arranged on the front side and another-side intake valve 5B arranged on the rear side in parallel to the one-side intake valve 5A as valves opening and closing a port communicated with a combustion chamber for each cylinder. The axes of the one-side intake valve 5A and the other-side intake valve 5B are inclined toward the right side by a predetermined angle in a front view. The one-side intake valve 5A and the other-side intake valve 5B are supported by the cylinder head to be reciprocatable in the vertical direction.

Furthermore, the cylinder head of the internal combustion engine 1 is provided with a one-side roller-type rocker arm 6A for opening and closing the valve by moving the one-side intake valve 5A in the axial direction (vertical direction), and another-side roller-type rocker arm 6B for opening and closing the valve by moving the other-side intake valve 5B in the axial direction (vertical direction).

The one-side roller-type rocker arm 6A includes a one-side roller 8A rotatably supported by a one-side roller pin 7A on a central part. The base end part on the right side of the one-side roller-type rocker arm 6A is supported from below by a one-side hydraulic lash adjuster 9A, and the lower surface on the distal end part on the left side of the one-side roller-type rocker arm 6A is arranged so as to be in contact with the upper end part of the one-side intake valve 5A.

The other-side roller-type rocker arm 6B includes another-side roller 8B rotatably supported by the other-side roller pin 7B on a central part. The base end part on the right side of the other-side roller-type rocker arm 6B is supported from below by another-side hydraulic lash adjuster 9B, and the lower surface on the distal end part on the left side of the other-side roller-type rocker arm 6B is arranged so as to be in contact with the upper end part of the other-side intake valve 5B.

A variable valve gear 10 that changes the lift characteristics of the one-side intake valve 5A and the other-side intake valve 5B is provided between the drive camshaft 2 and the one-side roller-type rocker arm 6A and the other-side roller-type rocker arm 6B.

The variable valve gear 10 includes a one-side control shaft 11A and another-side control shaft 11B as control shafts which are rotatable on the outer peripheral surface of the drive camshaft 2 and arranged coaxially with the drive camshaft 2, an oscillating camshaft 12 arranged in parallel with the drive camshaft 2, a cam follower 13 arranged between the drive camshaft 2 and the oscillating camshaft 12, and a one-side oscillating cam 14A and another-side oscillating cam 14B as oscillating cams oscillatably arranged on the oscillating camshaft 12.

Figure 6:
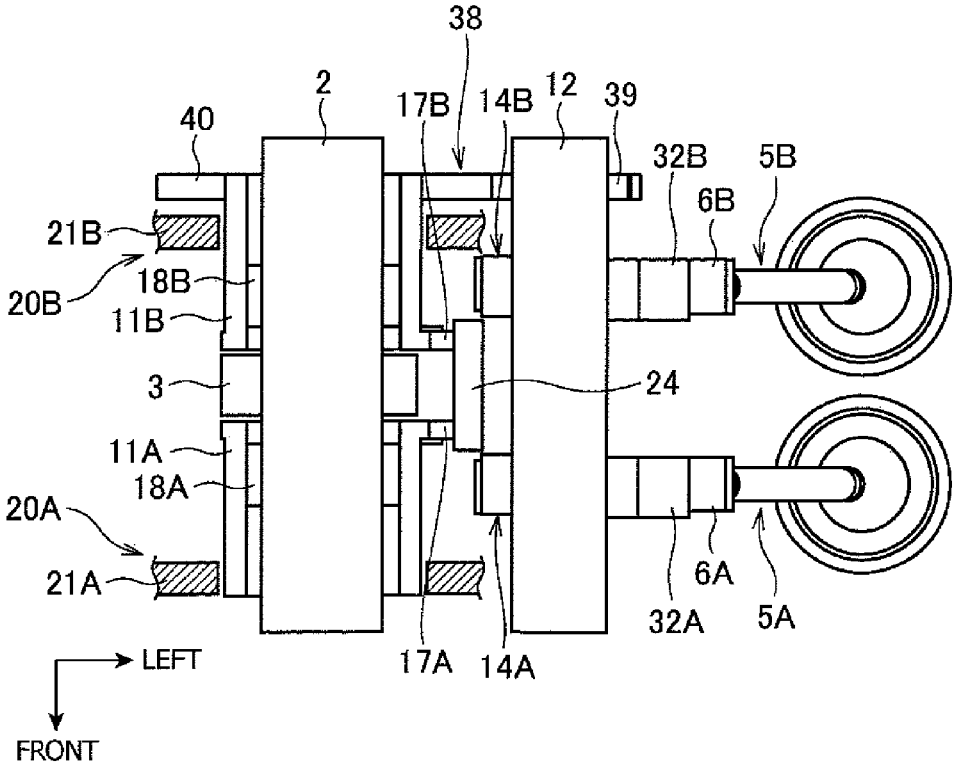
FIG. 6 is an enlarged cross-sectional view showing the variable valve gear taken along the line VI-VI of FIG. 5.

As shown in FIGS. 1 and 6, the one-side control shaft 11A integrally includes a hollow one-side body 16A forming a one-side shaft hole 15A through which the drive camshaft 2 is inserted on the front side of the drive cam 3, and a one-side control arm part 17A extending from the one-side body 16A toward the outer side in the radial direction. The one-side control shaft 11A is rotatably arranged on the outer peripheral surface of the drive camshaft 2 via a circular one-side rolling bearing (needle bearing) 18A. The other-side control shaft 11B integrally includes a hollow other-side body 16B forming another-side shaft hole 15B through which the drive camshaft 2 is inserted at the rear side of the drive cam 3, and another-side control arm part 17B extending from the other-side body 16B toward the outer side in the radial direction. The other-side control shaft 11B is rotatably arranged on the outer peripheral surface of the drive camshaft 2 via a circular other-side rolling bearing (needle bearing) 18B.

A one-side bearing hole 19A and another-side bearing hole 19B through which the drive camshaft 2 is inserted are formed in the one-side rolling bearing 18A and the other-side rolling bearing 18B. Thus, the drive camshaft 2 is rotatably arranged on the inner peripheral surfaces of the one-side control shaft 11A and the other-side control shaft 11B via the one-side rolling bearing 18A and the other-side rolling bearing 18B.

As shown in FIG. 6, the outer peripheral surfaces of the one-side control shaft 11A and the other-side control shaft 11B are rotatably supported by a one-side bearing part 21A and another-side bearing part 21B of a one-side cam housing 20A and another-side cam housing 20B.

A one-side support shaft hole 22A and another-side support shaft hole 22B are formed on distal ends of the one-side control arm part 17A and the other-side control arm part 17B.

As shown in FIG. 1, the cam follower 13 includes a cam follower body 24 extending from a longitudinal one-end part 23A on the lower side toward a longitudinal other-end part 23B on the upper side.

Figure 5:
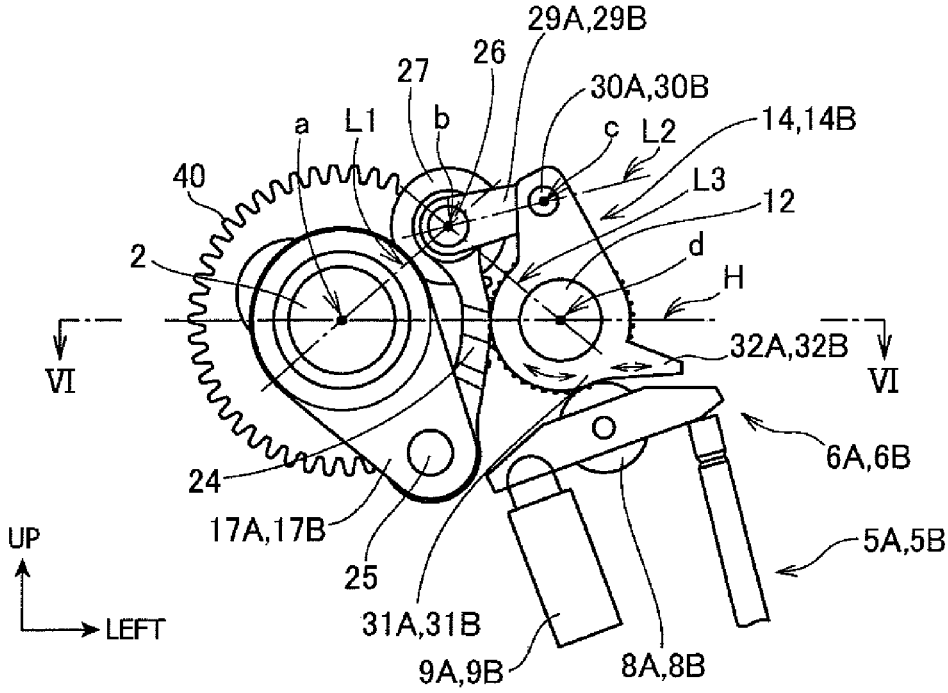
FIG. 5 is an elevation view showing the variable valve gear of the internal combustion engine according to the embodiment of the present invention.

The longitudinal one-end part 23A is oscillatably connected to a support shaft 25. On the other hand, the longitudinal other-end part 23B is branched into two parts to support a central shaft 26, and includes a cam follower roller 27 rotatably contacting the drive cam 3 on the axially central part of the central shaft 26. As shown in FIG. 5, the longitudinal other-end part 23B is arranged between the drive camshaft 2 and the oscillating camshaft 12 to cross through a reference line H which is a straight line connecting a center a of the drive cam 3 (shaft center of the drive camshaft 2) and a center d of the one-side oscillating cam 14A and the other-side oscillating cam 14B (shaft center of the oscillating camshaft 12).

Figure 3:
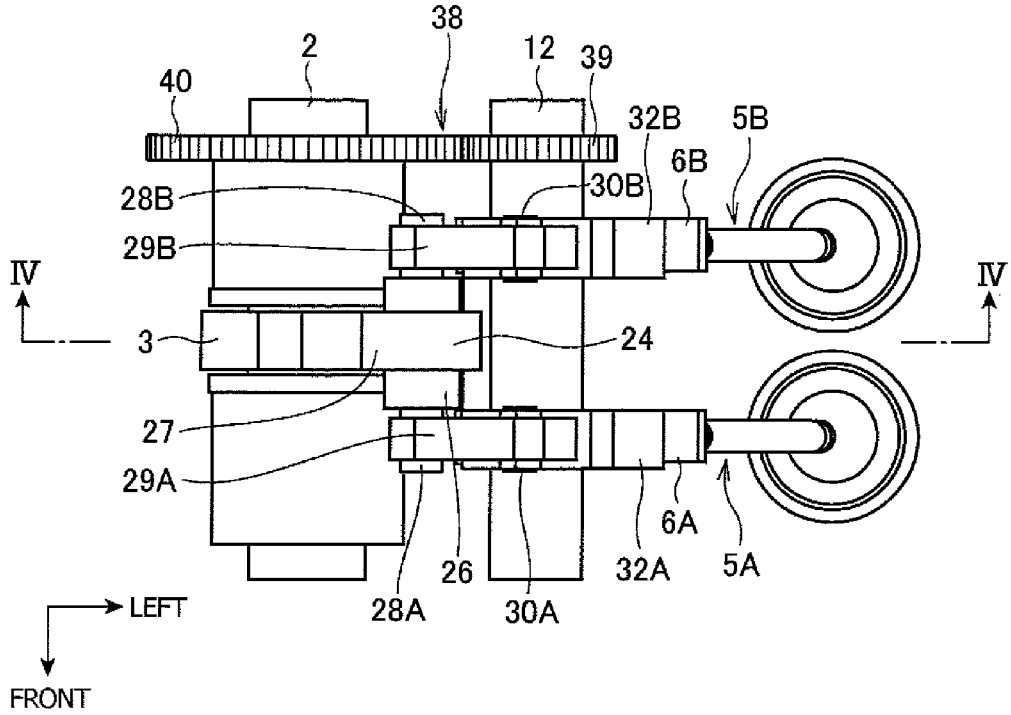
FIG. 3 is a plan view showing the variable valve gear of the internal combustion engine according to the embodiment of the present invention.
Figure 4:
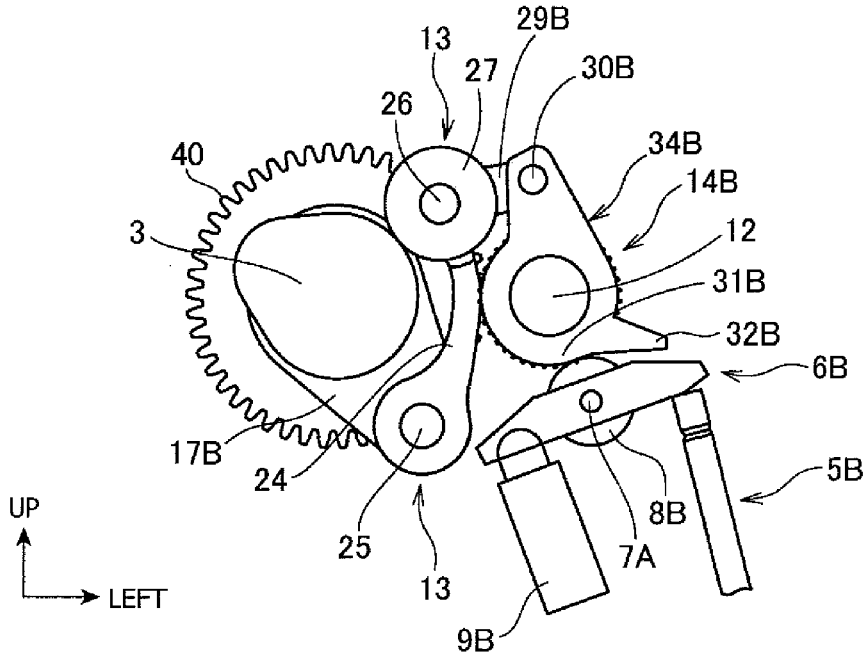
FIG. 4 is a cross-sectional view showing the variable valve gear taken along the line IV-IV of FIG. 3.

As shown in FIGS. 1 and 3, the cam follower body 24 is provided with a one-side link shaft part 28A and another-side link shaft part 28B coaxial with the central shaft 26 which are projected from both ends of the longitudinal other-end part 23B.

Base end parts of a one-side link arm 29A and another-side link arm 29B are oscillatably mounted to the one-side link shaft part 28A and the other-side link shaft part 28B. A one-side connection pin 30A and another-side connection pin 30B are provided on distal end parts of the one-side link arm 29A and the other-side link arm 29B.

Meanwhile, the cam follower 13 is oscillatably mounted to the one-side control arm part 17A and the other-side control arm part 17B via the support shaft 25 by mounting both ends of the support shaft 25 to the one-side support shaft hole 22A and the other-side support shaft hole 22B of the one-side control arm part 17A and the other-side control arm part 17B of the one-side control shaft 11A and the other-side control shaft 11B.

The one-side oscillating cam 14A includes a one-side base part 31A on the lower left side and a one-side lift part 32A on the lower right side in the horizontal direction. The one-side oscillating cam 14A further includes a one-side oscillating cam body 34A in which a one-side oscillating camshaft hole 33A is formed through which the oscillating camshaft 12 is inserted. The one-side oscillating cam 14A is oscillatably arranged on the oscillating camshaft 12 inserted through the one-side oscillating camshaft hole 33A.

The other-side oscillating cam 14B includes another-side base part 31B on the lower left side and another-side lift part 32B on the lower right side in the horizontal direction. The other-side oscillating cam 14B further includes another-side oscillating cam body 34B with another-side oscillating camshaft hole 33B through which the oscillating camshaft 12 is inserted. The other-side oscillating cam 14B is oscillatably arranged on the oscillating camshaft 12 inserted through the other-side oscillating camshaft hole 33B. The one-side oscillating cam 14A and the other-side oscillating cam 14B are oscillatably connected to the oscillating camshaft 12 inserted into the one-side oscillating camshaft hole 33A and the other-side oscillating camshaft hole 33B.

As viewed in the axial direction of the oscillating camshaft 12, a one-side oscillating arm part 35A and another-side oscillating arm part 35B, which extend toward the position opposite to the drive cam 3 across the cam follower roller 27, are integrally provided on the one-side oscillating cam body 34A and the other-side oscillating cam body 34B.

The one-side oscillating arm part 35A includes a pair of one-side arms 37A and 37A in which one-side pin holes 36A and 36A are formed on their distal end sides. The other-side oscillating arm part 35B includes a pair of other-side arms 37B and 37B in which other-side pin holes 36B and 36B are formed on their distal end sides.

The one-side link arm 29A is arranged between the pair of one-side arms 37A and 37A. By inserting both ends of the one-side connection pin 30A penetrating the one-side link arm 29A into the one-side pin holes 36A and 36A, the one-side link arm 29A is slidably connected to the one-side arms 37A and 37A.

The other-side link arm 29B is arranged between the pair of other-side arms 37B and 37B. By inserting both ends of the other-side connection pin 30B penetrating the other-side link arm 29B into the other-side pin holes 36B and 36B, the other-side link arm 29B is slidably connected to the other-side arms 37B and 37B.

Therefore, the central shaft 26 of the cam follower roller 27 is connected to the one-side oscillating arm part 35A and the other-side oscillating arm part 35B by the one-side link arm 29A and the other-side link arm 29B having both longitudinal ends rotatably connected to the central shaft 26 of the cam follower roller 27, the one-side oscillating arm part 35A, and the other-side oscillating arm part 35B. In the other words, the one-side link arm 29A and the other-side link arm 29B are connected to the one-side oscillating arm part 35A and the other-side oscillating arm part 35B by the one-side connection pin 30A and the other-side connection pin 30B.

A gear train 38 for transmitting the drive force from the oscillating camshaft 12 to the other-side control shaft 11B is arranged between the oscillating camshaft 12 and the other-side control shaft 11B as a control shaft.

The gear train 38 includes a drive gear 39 integrally mounted to the rear end of the oscillating camshaft 12, and a driven gear 40 engaged with the drive gear 39 and integrally mounted to the other-side body 16B of the other-side control shaft 11B. The diameter of the driven gear 40 is set to be larger than the diameter of the drive gear 39. Thus, the one-side control shaft 11A and the other-side control shaft 11B are structured to rotate by the rotation of the oscillating camshaft 12.

The variable valve gear 10 opens and closes the one-side intake valve 5A and the other-side intake valve 5B by transmitting the oscillation of the cam follower 13 to the one-side oscillating cam 14A and the other-side oscillating cam 14B, while changing the lift characteristics of the one-side intake valve 5A and the other-side intake valve 5B by relatively moving the center b of the cam follower roller 27 with respect to the center d of the one-side oscillating cam 14A and the other-side oscillating cam 14B. More specifically, when the oscillating camshaft 12 is rotated in accordance with the operation condition of the internal combustion engine 1, the one-side control arm part 17A and the other-side control arm part 17B are oscillated via the drive gear 39 and the driven gear 40 of the gear train 38. Then, the position of the cam follower roller 27 is changed, and the postures of the one-side oscillating cam 14A and the other-side oscillating cam 14B are changed by the one-side link arm 29A and the other-side link arm 29B. Accordingly, the lift characteristics of the one-side intake valve 5A and the other-side intake valve 5B are changed.

Figure 7B:
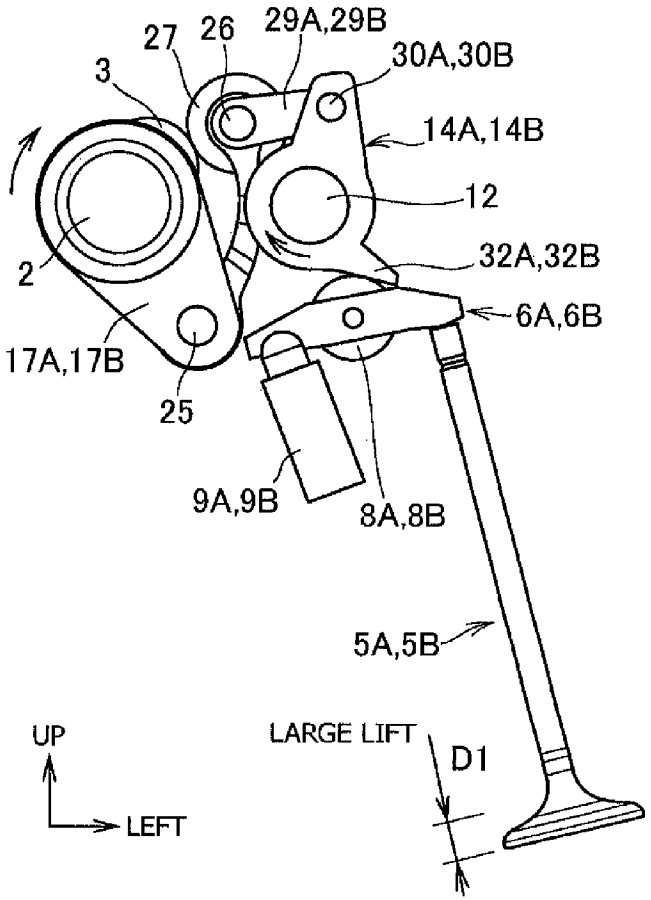
FIG. 7B is an elevation view showing behavior of the valve during large lift and operation mode according to the embodiment of the present invention.
Figure 7A:
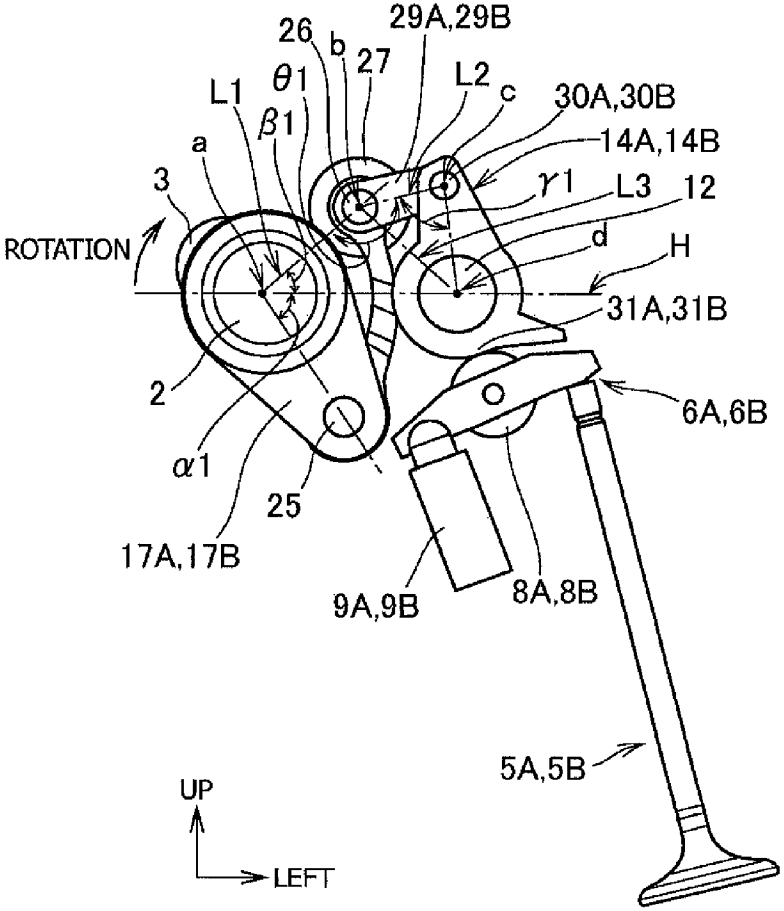
FIG. 7A is an elevation view showing behavior of a valve during large lift and non-operation mode according to the embodiment of the present invention.

As shown in FIGS. 5 and 7A, in the variable valve gear 10, when the one-side control shaft 11A and the other-side control shaft 11B are rotated in such a direction that the lift amounts of the one-side intake valve 5A and the other-side intake valve 5B are increased while the one-side intake valve 5A and the other-side intake valve 5B are not lifted, an angle between a first straight line L1 connecting the center a of the drive cam 3 and the center b of the cam follower roller 27 and a second straight line L2 connecting the center b of the cam follower roller 27 and the center c of the one-side connection pin 30A and the other-side connection pin 30B is increased.

Furthermore, as shown in FIGS. 5 and 7A, in the variable valve gear 10, when the one-side control shaft 11A and the other-side control shaft 11B are positioned so that the lift amounts of the one-side intake valve 5A and the other-side intake valve 5B are the maximum, the angle between the first straight line L1 connecting the center a of the drive cam 3 and the center b of the cam follower roller 27 and the second straight line L2 connecting the center b of the cam follower roller 27 and the center c of the one-side connection pin 30A and the other-side connection pin 30B is close to 180 degrees.

Furthermore, as shown in FIGS. 5 and 7A, in the variable valve gear 10, when the rotational direction of the drive cam 3 and the rotational direction of the one-side oscillating cam 14A and the other-side oscillating cam 14B in lifting the one-side intake valve 5A and the other-side intake valve 5B are set to be the same while the center c of the one-side connection pin 30A and the other-side connection pin 30B is arranged on the opposite side of the center a of the drive cam 3 across a third straight line L3 connecting the center b of the cam follower roller 27 and the center d of the one-side oscillating cam 14A and the other-side oscillating cam 14B, and the one-side control shaft 11A and the other-side control shaft 11B are rotated in the direction opposite to the rotational direction of the drive cam 3, the lift amounts of the one-side intake valve 5A and the other-side intake valve 5B are reduced.

Next, the operation of the variable valve gear 10 during large lift and during small lift of the one-side intake valve 5A and the other-side intake valve 5B will be explained below.

As shown in FIG. 7A, during large lift and non-operation mode of the one-side intake valve 5A and the other-side intake valve 5B, an angle of the cam follower roller 27 relative to a reference line H is $\beta 1$ when an angle of the one-side control arm part 17A and the other-side control arm part 17B relative to the reference line H is $\alpha 1$. At this time, the one-side oscillating cam 14A and the other-side oscillating cam 14B are in contact with the one-side roller 8A and the other-side roller 8B of the one-side roller-type rocker arm 6A and the other-side roller-type rocker arm 6B at a portion close to a boundary with the one-side lift part 32A and the other-side lift part 32B of the one-side base part 31A and the other-side base part 31B. An angle $\theta 1$ between the first straight line L1 connecting the center a of the drive cam 3 and the center b of the cam follower roller 27 and the second straight line L2 connecting the center b of the cam follower roller 27 and the center c of the one-side connection pin 30A and the other-side connection pin 30B is close to 180 degrees.

As shown in FIG. 7B, when the drive cam 3 is rotated and the drive force is transmitted to the one-side oscillating arm part 35A and the other-side oscillating arm part 35B of the one-side oscillating cam 14A and the other-side oscillating cam 14B via the cam follower roller 27, the one-side link arm 29A, and the other-side link arm 29B, the one-side intake valve 5A and the other-side intake valve 5B are pushed by the one-side lift part 32A and the other-side lift part 32B of the one-side oscillating cam 14A and the other-side oscillating cam 14B, and thus are lifted largely by a predetermined distance D1 (large lift). At this time, because the angle $\theta 1$ between the first straight line L1 and the second straight line L2 is close to 180 degrees, the lift of the drive cam 3 can be effectively converted into the movement of the one-side oscillating cam 14A and the other-side oscillating cam 14B. In other words, the lift amounts of the one-side intake valve 5A and the other-side intake valve 5B can be easily provided, which contributes to the improvement of the maximum output of the internal combustion engine 1.

Figure 8B:
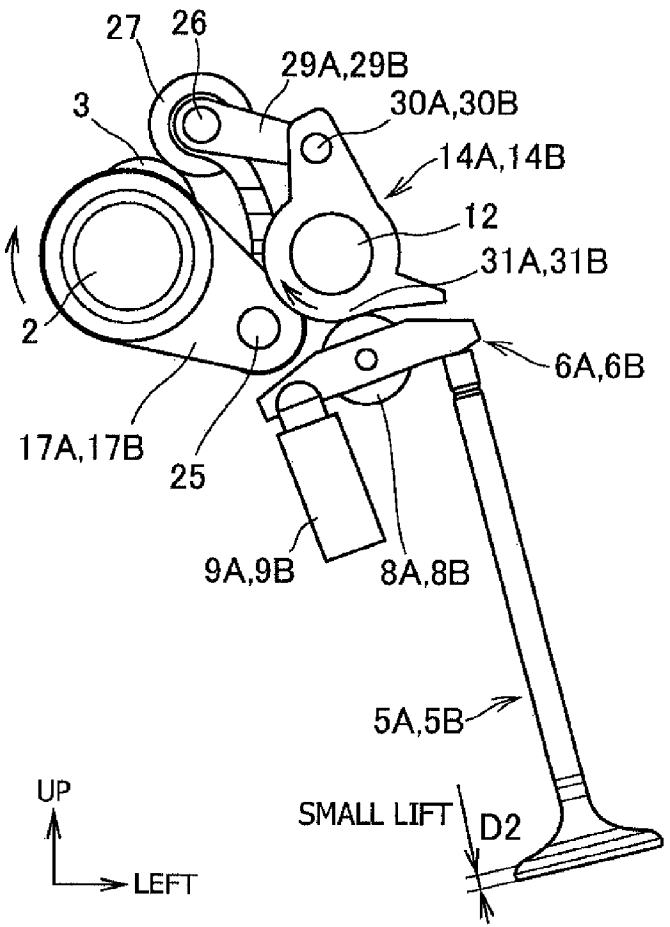
FIG. 8B is an elevation view showing behavior of the valve during small lift and operation mode according to the embodiment of the present invention.
Figure 8A:
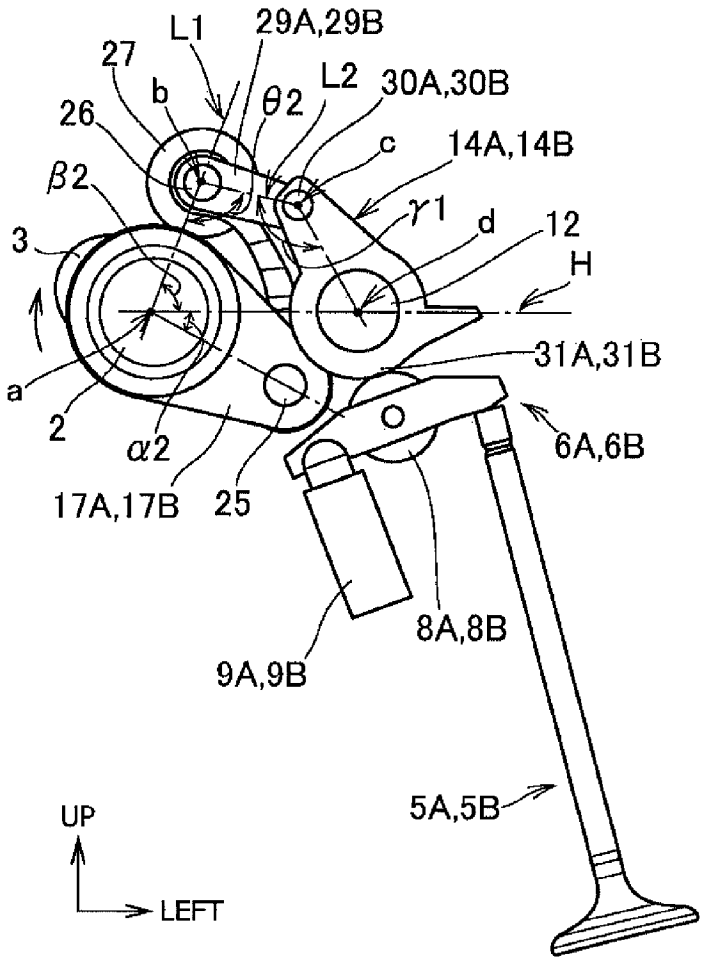
FIG. 8A is an elevation view showing behavior of the valve during small lift and non-operation mode according to the embodiment of the present invention.

On the other hand, as shown in FIG. 8A, during small lift and non-operation mode of the one-side intake valve 5A and the other-side intake valve 5B, the angle of the one-side control arm part 17A and the other-side control arm part 17B relative to the reference line H is reduced to $\alpha 2$ from $\alpha 1$, and the angle of the cam follower roller 27 relative to the reference line H is changed to $\beta 2$ from $\beta 1$. At this time, the one-side oscillating cam 14A and the other-side oscillating cam 14B are in contact with the one-side roller 8A and the other-side roller 8B of the one-side roller-type rocker arm 6A and the other-side roller-type rocker arm 6B at a portion away from the one-side lift part 32A and the other-side lift part 32B of the one-side base part 31A and the other-side base part 31B. An angle $\theta 2$ between the first straight line L1 connecting the center a of the drive cam 3 and the center b of the cam follower roller 27 and the second straight line L2 connecting the center b of the cam follower roller 27 and the center c of the one-side connection pin 30A and the other-side connection pin 30B is smaller than the angle $\theta 1$. Thus, the rotation radius of the center b of the cam follower roller 27 centering on the center d of the one-side oscillating cam 14A and the other-side oscillating cam 14B is increased and the oscillation amounts of the one-side oscillating cam 14A and the other-side oscillating cam 14B are reduced. Thus, the friction and the inertial force of the one-side oscillating cam 14A and the other-side oscillating cam 14B are suppressed and the fuel consumption is improved.

As shown in FIG. 8B, when the drive force of the drive cam 3 is transmitted to the one-side oscillating arm part 35A and the other-side oscillating arm part 35B of the one-side oscillating cam 14A and the other-side oscillating cam 14B via the cam follower roller 27, the one-side link arm 29A, and the other-side link arm 29B, a section where the one-side base part 31A and the other-side base part 31B of the one-side oscillating cam 14A and the other-side oscillating cam 14B are in contact with the one-side roller 8A and the other-side roller 8B of the one-side roller-type rocker arm 6A and the other-side roller-type rocker arm 6B is long. Thus, the lift amounts become the minimum (small lift) when the one-side intake valve 5A and the other-side intake valve 5B are moved only by a distance D2 smaller than the distance D1.

During the large lift mode and the small lift mode, the angle $\beta$ between the reference line H and the first straight line L1 connecting the center a of the drive cam 3 and the center b of the cam follower roller 27 (the rotation angle of the cam follower roller 27) is changed. More specifically, the angle $\beta$ between the reference line H and the first straight line L1 is increased ($\beta 2 > \beta 1$) as the lift amount is decreased, and thus the valve timing is advanced.

Figure 9:
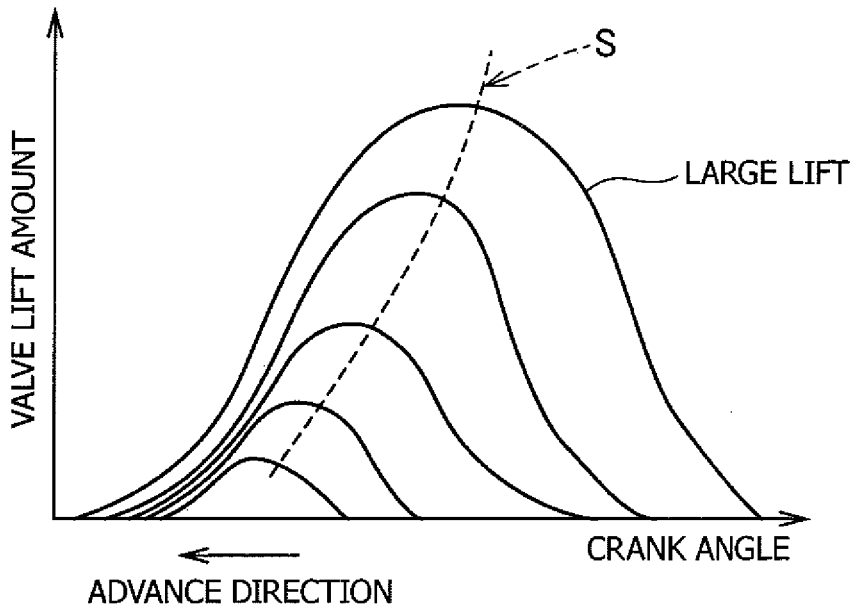
FIG. 9 is a graph showing a lift amount of the valve relative to a crank angle according to the embodiment of the present invention.
Figure 10:
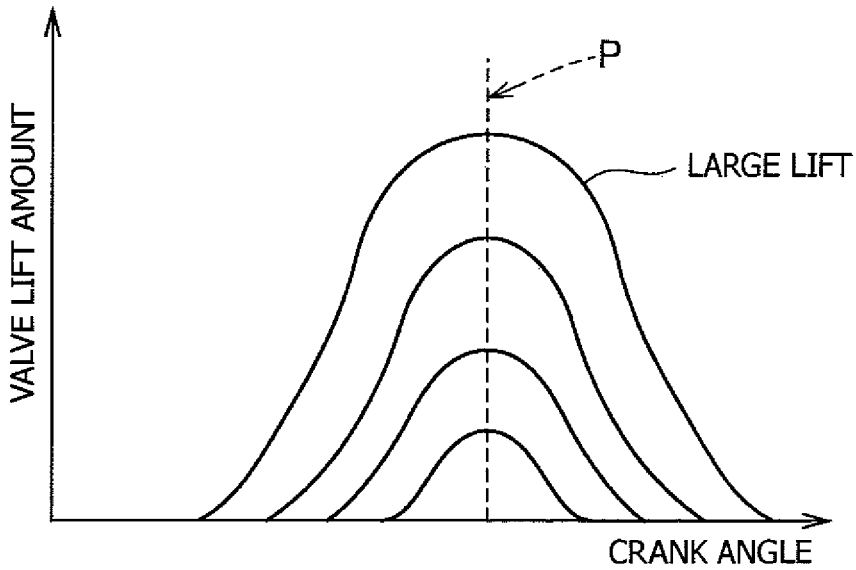
FIG.10 (RELATED ART)
FIG. 10 is a graph showing a lift amount of a valve relative to a crank angle in a conventional example.

Accordingly, as shown in FIG. 9, the one-side intake valve 5A and the other-side intake valve 5B are closed earlier as the lift amount is decreased (as shown by a dashed line S). In other words, the timing for closing the one-side intake valve 5A and the other-side intake valve 5B can be moved in the advance direction as compared to a conventional timing. Due to such a mirror cycle effect, the pumping loss of the internal combustion engine 1 can be reduced and the fuel consumption can be improved.

Since the rotation angle $\beta$ of the cam follower roller 27 is changed linearly in accordance with the change of the rotation angle $\alpha$ of the one-side control shaft 11A and the other-side control shaft 11B by arranging the drive camshaft 2 coaxially with the one-side control shaft 11A and the other-side control shaft 11B, the valve timing is changed linearly in accordance with the rotation of the one-side control shaft 11A and the other-side control shaft 11B. Thus, the valve timing can be controlled precisely.

Furthermore, since the one-side lift part 32A and the other-side lift part 32B of the one-side oscillating cam 14A and the other-side oscillating cam 14B are projected toward the opposite side of the drive cam 3 and the movement range of the cam follower roller 27 is provided not to cross through the reference line H connecting the center a of the drive cam 3 and the center d of the one-side oscillating cam 14A and the other-side oscillating cam 14B, the distance between the axis of the drive camshaft 2 and the axis of the oscillating camshaft 12 can be shortened and the variable valve gear 10 can be reduced in size.

Next, the configuration according to the embodiment of the present invention described above will be explained in accordance with each aspect of the invention.

In the invention according to a first aspect, the one-side control shaft 11A and the other-side control shaft 11B having the hollow one-side body 16A and the hollow other-side body 16B and the one-side control arm part 17A and the other-side control arm part 17B extending from the one-side body 16A and the other-side body 16B toward the outer side in the radial direction are rotatably provided on the outer peripheral surface of the drive camshaft 2. The cam follower 13 is oscillatably mounted to the one-side control arm part 17A and the other-side control arm part 17B via the support shaft 25, and the one-side oscillating arm part 35A and the other-side oscillating arm part 35B extending toward the position opposite to the drive cam 3 across the cam follower roller 27 are provided on the one-side oscillating cam 14A and the other-side oscillating cam 14B. The central shaft 26 of the cam follower roller 27 is connected to the one-side oscillating arm part 35A and the other-side oscillating arm part 35B by the one-side link arm 29A and the other-side link arm 29B of which both longitudinal ends are rotatably connected to the central shaft 26 of the cam follower roller 27, the one-side oscillating arm part 35A, and the other-side oscillating arm part 35B.

Accordingly, the oscillation of the cam follower roller 27 mounted to the cam follower 13 is transmitted to the one-side connection pin 30A and the other-side connection pin 30B mounted to the one-side oscillating cam 14A and the other-side oscillating cam 14B by the one-side link arm 29A and the other-side link arm 29B. Thus, the one-side oscillating cam 14A and the other-side oscillating cam 14B can be oscillated. When the one-side control shaft 11A and the other-side control shaft 11B are rotated and the center b of the cam follower roller 27 is relatively moved with respect to the center d of the one-side oscillating cam 14A and the other-side oscillating cam 14B, the one-side oscillating cam 14A and the other-side oscillating cam 14B are oscillated by the one-side link arm 29A and the other-side link arm 29B. Thus, the lift characteristics of the one-side intake valve 5A and the other-side intake valve 5B can be changed. Consequently, the oscillation force can be transmitted from the cam follower 13 to the one-side oscillating cam 14A and the other-side oscillating cam 14B and the mechanism for changing the lift characteristics of the one-side intake valve 5A and the other-side intake valve 5B can be simplified. Furthermore, the device can be reduced in size, and thus, the mountability of the variable valve gear 10 to the internal combustion engine 1 can be improved.

In the invention according to a second aspect, the one-side link arm 29A and the other-side link arm 29B are connected to the one-side oscillating arm part 35A and the other-side oscillating arm part 35B by the one-side connection pin 30A and the other-side connection pin 30B. When the one-side control shaft 11A and the other-side control shaft 11B are rotated in such a direction that the lift amounts of the one-side intake valve 5A and the other-side intake valve 5B are increased while the one-side intake valve 5A and the other-side intake valve 5B are not lifted, the angle θ1 between the first straight line L1 connecting the center a of the drive cam 3 and the center b of the cam follower roller 27 and the second straight line L2 connecting the center b of the cam follower roller 27 and the center c of the one-side connection pin 30A and the other-side connection pin 30B is increased.

Accordingly, as the lift amounts of the one-side intake valve 5A and the other-side intake valve 5B are increased, the angle θ1 between the first straight line L1 connecting the center a of the drive cam 3 and the center b of the cam follower roller 27 and the second straight line L2 connecting the center b of the cam follower roller 27 and the center c of the one-side connection pin 30A and the other-side connection pin 30B is increased, and accordingly, the oscillation amount input from the drive cam 3 to the one-side oscillating cam 14A and the other-side oscillating cam 14B can be increased. Thus, the one-side oscillating cam 14A and the other-side oscillating cam 14B can be reduced in size and the mountability of the variable valve gear 10 to the internal combustion engine 1 can be improved.

In the invention according to a third aspect, when the one-side control shaft 11A and the other-side control shaft 11B are positioned so that the lift amounts of the one-side intake valve 5A and the other-side intake valve 5B are the maximum, the angle θ1 between the first straight line L1 connecting the center a of the drive cam 3 and the center b of the cam follower roller 27 and the second straight line L2 connecting the center b of the cam follower roller 27 and the center c of the one-side connection pin 30A and the other-side connection pin 30B is close to 180 degrees.

Thus, the oscillation amount transmitted from the drive cam 3 to the one-side oscillating arm part 35A and the other-side oscillating arm part 35B can be the maximum when the lift amounts of the one-side intake valve 5A and the other-side intake valve 5B are the maximum.

In the invention according to a fourth aspect, the outer peripheral surfaces of the one-side control shaft 11A and the other-side control shaft 11B are rotatably supported by the one-side bearing part 21A and the other-side bearing part 21B of the one-side cam housing 20A and the other-side cam housing 20B, and the drive camshaft 2 is rotatably supported on the inner peripheral surfaces of the one-side control shaft 11A and the other-side control shaft 11B via one-side rolling bearing 18A and the other-side rolling bearing 18B.

Therefore, the variable valve gear 10 can be reduced in size by arranging the one-side control shaft 11A and the other-side control shaft 11B coaxially with the drive camshaft 2, while the drive camshaft 2 can be rotatably supported on the one-side cam housing 20A and the other-side cam housing 20B via the one-side rolling bearing 18A and the other-side rolling bearing 18B and the one-side control shaft 11A and the other-side control shaft 11B. Even though the drive camshaft 2 can be provided coaxially with the one-side control shaft 11A and the other-side control shaft 11B, the drive camshaft 2 is supported only by the one-side rolling bearing 18A and the other-side rolling bearing 18B and does not contact the one-side cam housing 20A and the other-side cam housing 20B. Thus, the frictional loss of the drive camshaft 2 can be reduced.

In the invention according to a fifth aspect, the drive cam 3 is formed separately from the drive camshaft 2.

Thus, in the multilayered internal combustion engine 1, when the hollow one-side control shaft 11A and the hollow other-side control shaft 11B are mounted at a portion sandwiched between two drive cams 3 and 3 in the axial direction of the drive camshaft 2, the one-side control shaft 11A, the other-side control shaft 11B, and the drive cams 3 can be alternately mounted at the drive camshaft 2. The mountability of the one-side control shaft 11A and the other-side control shaft 11B to the drive camshaft 2 can be improved.

In the invention according to a sixth aspect, the valve is provided by the one-side intake valve 5A and the other-side intake valve 5B. When the rotational direction of the drive cam 3 and the rotational direction of the one-side oscillating cam 14A and the other-side oscillating cam 14B in lifting the one-side intake valve 5A and the other-side intake valve 5B are set to be the same, and the center c of the one-side connection pin 30A and the other-side connection pin 30B is arranged on the opposite side of the center a of the drive cam 3 across the third straight line L3 connecting the center b of the cam follower roller 27 and the center d of the one-side oscillating cam 14A and the other-side oscillating cam 14B to rotate the one-side control shaft 11A and the other-side control shaft 11B in the direction opposite to the rotational direction of the drive cam 3, the lift amounts of the one-side intake valve 5A and the other-side intake valve 5B are reduced.

Therefore, as the lift amounts of the one-side intake valve 5A and the other-side intake valve 5B are reduced, the timing for closing the one-side intake valve 5A and the other-side intake valve 5B can be advanced. Thus, the pumping loss can be reduced due to the mirror cycle effect of the internal combustion engine 1.

In the invention according to a seventh aspect, the gear train 38 for transmitting the drive force from the oscillating camshaft 12 to the one-side control shaft 11A and the other-side control shaft 11B is arranged between the oscillating camshaft 12 and the one-side control shaft 11A and the other-side control shaft 11B. The one-side control shaft 11A and the other-side control shaft 11B are rotated by the rotation of the oscillating camshaft 12.

Since the drive force is transmitted from the oscillating camshaft 12 to the one-side control shaft 11A and the other-side control shaft 11B, a dedicated drive shaft for rotating the one-side control shaft 11A and the other-side control shaft 11B is not necessary. Thus, the variable valve mechanism 10 can be reduced in size and the cost can be reduced.

The variable valve gear according to the present invention is applicable to internal combustion engines of various vehicles.

The invention claimed is:

1. A variable valve gear of an internal combustion engine for opening and closing a valve by transmitting oscillation of a cam follower to an oscillating cam and changing lift characteristics of the valve by relatively moving a center of a cam follower roller with respect to a center of the oscillating cam, comprising:

a drive camshaft including a drive cam;

the oscillating cam including a base part and a lift part on an oscillating camshaft arranged in parallel with the drive camshaft to be oscillatable;

the cam follower including a longitudinal one end oscillatably connected to a support shaft and a longitudinal other end having the cam follower roller contacting the drive cam, the cam follower being arranged between the drive camshaft and the oscillating camshaft to cross through a straight line connecting a center of the drive cam and a center of the oscillating cam, wherein a control shaft having a hollow body and a control arm part extending from the body toward an outer side in a radial direction is rotatably provided on an outer peripheral surface of the drive camshaft, the cam follower is oscillatably mounted to the control arm part via the support shaft, an oscillation arm part extending toward a position opposite to the drive cam across the cam follower roller is provided on the oscillating cam, and a central shaft of the cam follower roller and the oscillating arm part are connected to each other by a link arm of which both longitudinal ends are rotatably connected to the central shaft of the cam follower roller and the oscillating arm part.

2. The variable valve gear of the internal combustion engine according to claim 1, wherein an angle between a straight line connecting a center of the drive cam and a center of the cam follower roller and a straight line connecting a center of the cam follower roller and a center of a connection pin is increased when the control shaft is rotated in such a direction that a lift amount of the valve is increased while the link arm is connected to the oscillating arm part by the connection pin and the valve is not lifted.

3. The variable valve gear of the internal combustion engine according to claim 2, wherein the angle between the straight line connecting the center of the drive cam and the center of the cam follower roller and the straight line connecting the center of the cam follower roller and the center of the connection pin is close to 180 degrees when the control shaft is positioned so that the lift amount of the valve is the maximum.

4. The variable valve gear of the internal combustion engine according to claim 1, wherein an outer peripheral surface of the control shaft is rotatably supported by a bearing part of a cam housing and the drive camshaft is rotatably supported on an inner peripheral surface of the control shaft via a rolling bearing.

5. The variable valve gear of the internal combustion engine according to claim 1, wherein the drive cam is formed separately from the drive camshaft.

6. The variable valve gear of the internal combustion engine according to claim 1, wherein the valve is an intake valve, and a lift amount of the valve is reduced when a rotational direction of the drive cam and a rotational direction of the oscillating cam in lifting the valve are set to be the same while a center of the connection pin is arranged on an opposite side of a center of the drive cam across a straight line connecting a center of the cam follower roller and a center of the oscillating cam and the control shaft is rotated in a direction opposite to the rotational direction of the drive cam.

7. The variable valve gear of the internal combustion engine according to claim 1, further comprising a gear train for transmitting a drive force from the oscillating camshaft to the control shaft, the gear train being arranged between the oscillating camshaft and the control shaft, wherein the control shaft is rotated by rotation of the oscillating camshaft.

* * * * *